US009016601B2

(12) United States Patent
Headland et al.

(10) Patent No.: US 9,016,601 B2
(45) Date of Patent: Apr. 28, 2015

(54) FUEL DISTRIBUTOR

(75) Inventors: Paul Headland, Lincoln (GB); Richard Noden, Maltby (GB)

(73) Assignee: Siemens Aktiengesellschaft, München (DE)

( * ) Notice: Subject to any disclaimer, the term of this patent is extended or adjusted under 35 U.S.C. 154(b) by 631 days.

(21) Appl. No.: 12/600,531

(22) PCT Filed: May 9, 2008

(86) PCT No.: PCT/EP2008/055762

§ 371 (c)(1),
(2), (4) Date: Nov. 17, 2009

(87) PCT Pub. No.: WO2008/141955

PCT Pub. Date: Nov. 27, 2008

(65) Prior Publication Data

US 2010/0146979 A1 Jun. 17, 2010

(30) Foreign Application Priority Data

May 18, 2007 (EP) ..... 70099601

(51) Int. Cl.

| | |
|---|---|
| ***B05B 7/10*** | (2006.01) |
| ***F23R 3/28*** | (2006.01) |
| ***F23C 7/00*** | (2006.01) |
| ***F23R 3/14*** | (2006.01) |

(52) U.S. Cl.

CPC ..... *F23R 3/286* (2013.01); *F23C 7/004* (2013.01); *F23C 2900/07001* (2013.01); *F23R 3/14* (2013.01)

(58) Field of Classification Search

CPC ..... F23R 3/14; F23R 3/286; F23C 7/004; F23C 2900/07001

USPC ..... 239/463, 466, 470, 472, 487, 488, 239/494–498, 500–502, 522, 469, 486, 461, 239/399, 405; 60/746–748

See application file for complete search history.

(56) References Cited

U.S. PATENT DOCUMENTS

| | | | | |
|---|---|---|---|---|
| 5,901,555 | A | 5/1999 | Mandai et al. | |
| 6,279,543 | B1 * | 8/2001 | Niethammer et al. | 123/506 |
| 7,490,471 | B2 * | 2/2009 | Lynch et al. | 60/748 |
| 2007/0130954 | A1 * | 6/2007 | Lynch et al. | 60/776 |
| 2008/0083229 | A1 * | 4/2008 | Haynes et al. | 60/776 |

FOREIGN PATENT DOCUMENTS

| | | | |
|---|---|---|---|
| EP | 0870989 | A2 | 10/1998 |
| EP | 0936406 | A2 | 8/1999 |
| EP | 1394471 | A1 | 3/2004 |
| EP | 1507119 | A1 | 2/2005 |
| RU | 2122684 | C1 | 11/1998 |
| RU | 2145402 | C1 | 2/2000 |
| RU | 2260747 | C2 | 9/2005 |

* cited by examiner

*Primary Examiner* — Jason Boeckmann

(57) ABSTRACT

A swirler including a fuel distributor is provided. Each fuel distributor includes a distribution element defining a cavity, an inlet opening arranged in the distribution element, at least one outlet opening arranged in the distribution element, and at least one third opening arranged in the distribution element, the cross-section of the at least one third opening being larger than the cross-section of the at least one outlet opening.

11 Claims, 5 Drawing Sheets

FUEL DISTRIBUTOR

CROSS REFERENCE TO RELATED APPLICATIONS

This application is the U.S. National Stage of International Application No. PCT/EP2008/055762, filed May 9, 2008 and claims the benefit thereof. The International Application claims the benefits of European Patent Office application No. 07009960.1 EP filed May 18, 2007, both of the applications are incorporated by reference herein in their entirety.

FIELD OF THE INVENTION

The invention relates to a fuel distributor, in particular for a burner and a swirler.

BACKGROUND OF THE INVENTION

The main purpose of the burner is to mix fuel and air together to obtain stable and efficient combustion with good flame stability and the smallest possible amount of NOx emissions. Therefore, the burner design must ensure that the proper amounts of fuel and air are introduced in the right locations within the burner and that these amounts of fuel and air are thoroughly mixed, so that complete combustion takes place with a minimum amount of excess air in order to achieve optimum overall efficiency.

The two burner principles, which could be combined to use their respective advantages, are the premix combustion burner and the diffusion flame burner.

In the premix combustion burner, the air, required for combustion, is mixed with the burner fuel before delivery to the combustion zone. The better the mixing of fuel and air the less hot zones with a fuel/air ratio exceeding the stoichiometric requirements exist. Since flame temperature is the dominant factor driving NOx production it follows that the more fuel lean the mixture, the lower the NOx produced.

In the diffusion flame burner, the fuel is not mixed with the air ahead of the combustion zone, but delivered as pure fuel in the immediate vicinity of the combustion zone. Diffusion flame burners provide good flame stability. The NOx production is relatively high.

Low emission gas turbine engines often use a combustor with two operating modes including a pilot nozzle that forms a diffusion flame and a plurality of main nozzles for discharging a fuel/air mixture to form premixed flames as the main combustion around the diffusion flame. The U.S. Pat. No. 5,901,555 describes a conventional gas turbine with the main burners divided into a plurality of groups in accordance with the load. The flow rate of the pilot fuel is increased when the gas turbine load is low, to achieve stable combustion. When the gas turbine load is high, the ratio of the pilot fuel is decreased, to decrease the amount of NOx. Separately controllable fuel lines, valves, pipe work and a control logic are required to achieve the appropriate fuel flows to the pilot and main nozzles, increasing the cost of the engine.

SUMMARY OF THE INVENTION

An object of the invention is to provide an improved fuel distributor.

This object is achieved by the claims. The dependent claims describe advantageous developments and modifications of the invention.

An inventive fuel distributor uses the pressure gradient across the combustion system to control the proportion of fuel provided to different areas of the combustion system. These areas could provide pilot fuel at low loads, or better mixing of the fuel and air at high loads.

The system comprises a cavity with an inlet opening and at least two fuel injection openings. The fuel distributor relies on having a larger injection opening arranged in the cavity of the fuel distributor in an upstream section, relative to the flow of compressor air, and a smaller injection opening arranged in the cavity in a downstream section, relative to the flow of compressor air, and serving as feed near combustor pressure.

In an advantageous embodiment of the invention a restrictor is arranged at the inlet opening to balance between the fuel flows through the at least one smaller outlet opening and the at least one larger third opening, respectively.

In a further advantageous embodiment, the restrictor is adjustable to adapt the pressure for different fuel types.

Since at low fuel pressure fuel basically leaves the distributor at the outlet opening that is exposed to the lowest external air pressure, it is advantageous to use this outlet opening as pilot fuel injection opening.

For the same reason, it is advantageous to use the third opening with a larger cross-sectional area and exposed to higher external air pressure as main fuel injection opening.

In an advantageous embodiment the principle of the fuel distributor is applied to a diffusion flame burner, where the fuel distributor has a tubular form with the outlet opening at the end of the tube facing the combustion chamber and with third openings arranged upstream the tube, relative to the flow of the fuel. At low fuel flows, the majority of the fuel will enter the combustion chamber through the outlet opening. Compressor air can enter the fuel distributor through the third openings and give some premixing of the fuel and the air. As the fuel flow increases, the pressure in the cavity increases and fuel will spill out through the third openings and will mix with compressor air and enter the combustion chamber.

In another advantageous embodiment, the principle of the fuel distributor is applied to a swirler. The cavity of the fuel distributor is arranged in the base plate of the swirler. The fuel openings and the third openings are arranged in the mixing ducts, that is, in the passages of the swirler. The openings may be arranged in the base plate of the swirler or in the swirler vanes. If arranged in the swirler vanes, the arrangement could be at different heights to improve the fuel distribution over the swirler vane height. Smaller fuel outlet openings would be closer to the swirler exit hole with lower pressure. Larger third openings would rather be in an upstream part of the swirler passages relative to the flow of compressor air, with higher pressure. The fuel outlet openings would serve as pilot and the third openings as main fuel injection openings.

In yet another advantageous embodiment, the pressure drop of the air between an outlet opening and a third opening in a mixing duct or a swirler passage is controlled by making the mixing duct or swirler passage convergent or divergent.

With such a design of the fuel distribution system emissions of NOx are reduced. The inventive fuel distributor provides an increasing level of premix as the fuel flow increases. The inventive fuel distributor even provides some premixing of fuel and air at low flows, thus further reducing NOx emissions. Furthermore, the fuel/air mixing within a premix duct like e.g. a swirler passage can be varied as the fuel flow changes without the use of control valves, thus reducing costs and increasing reliability.

BRIEF DESCRIPTION OF THE DRAWINGS

The invention will now be further described with reference to the accompanying drawings in which.

Figure 1:
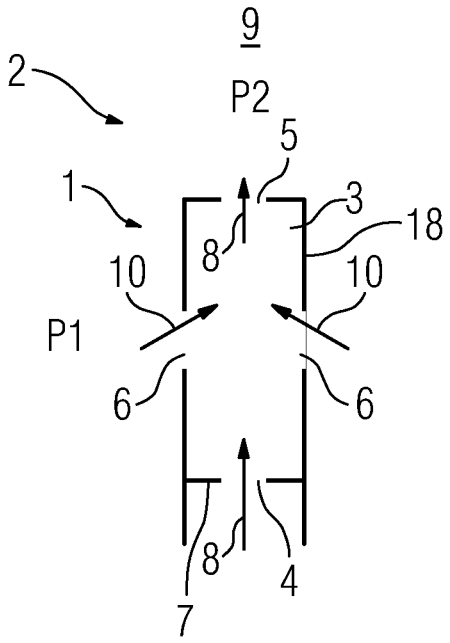
FIG. 1 represents an inventive diffusion flame burner at low fuel flow.

In the drawings like references identify like or equivalent parts.

DETAILED DESCRIPTION OF THE INVENTION

Figure 2:
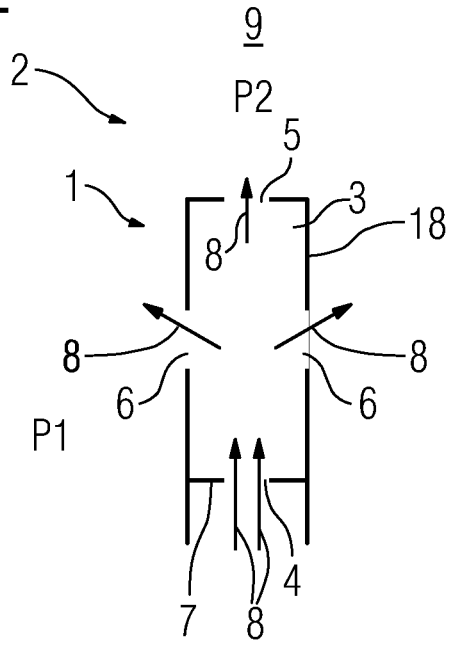
FIG. 2 represents an inventive diffusion flame burner at high fuel flow.

FIG. 1 shows the scheme of the inventive fuel distributor 1 applied in a diffusion flame burner 2. The fuel distributor 1 comprises a distribution element 18 defining a cavity 3 with an inlet opening 4, an outlet opening 5, opposing the inlet opening 4, and two third openings 6. The third openings 6 are larger than the outlet opening 5. A restrictor 7 is arranged upstream the inlet opening 4 relative to the fuel flow 8, and sized to give the correct pressure to balance the fuel flows 8 between the outlet opening 5 and the third openings 6. Pressure P1 at the third openings 6 is greater than pressure P2 at the outlet opening 5. At low fuel flows 8, the majority of the fuel 8 will enter the combustion chamber 9 through the outlet opening 5. If the fuel flow 8 is low enough, air 10 may enter the cavity 3 through third openings 6 and give some premixing of the fuel 8 and air 10. As the fuel flow 8 increases, the pressure in the cavity 3 increases. When the pressure in the cavity 3 is higher than P1, fuel 8 will spill out of the third openings 6, as shown in FIG. 2, and mix with air 10. The fuel/air premix will then enter the combustion chamber 9.

Figure 3:
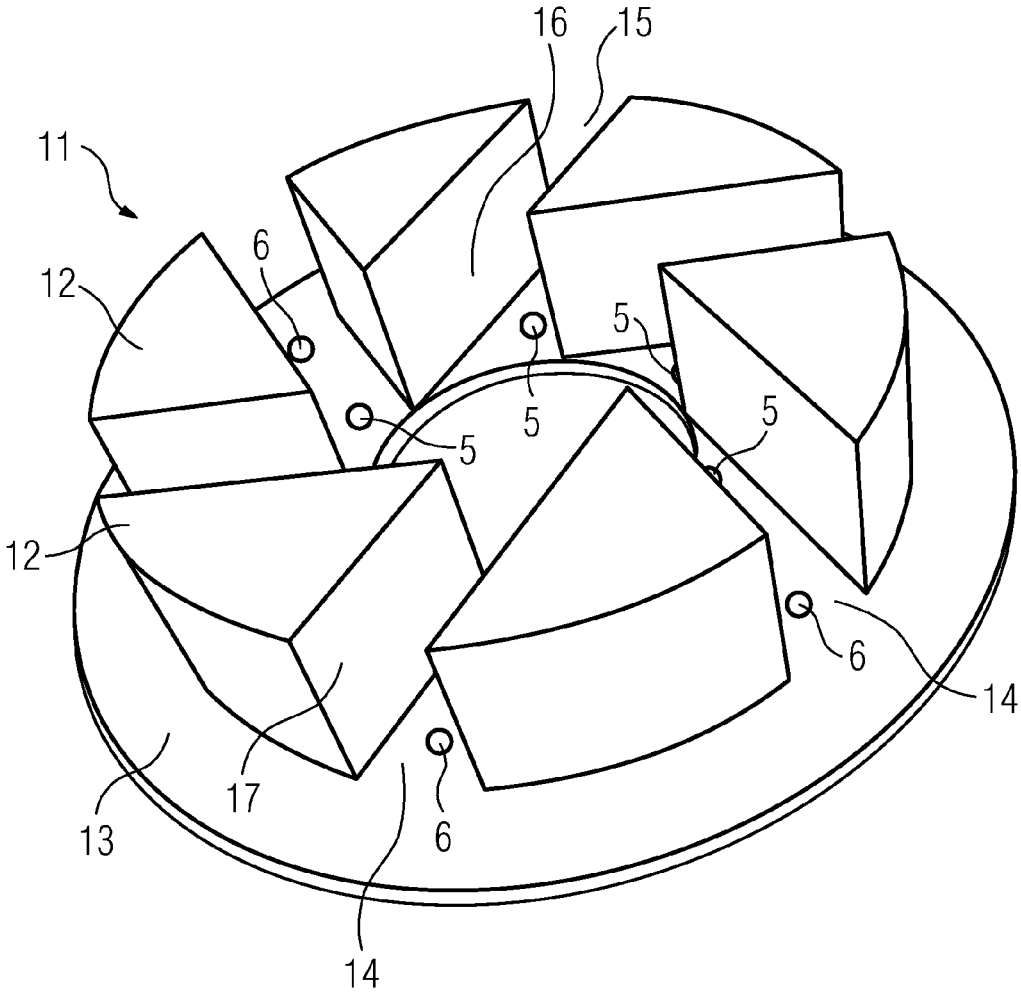
FIG. 3 represents a swirler.

Referring to FIG. 3 a swirler 11 for a gas turbine engine is shown. The swirler 11 comprises swirler vanes 12 arranged on a swirler vane support 13. The swirler vanes 12 can be fixed to a burner head (not shown) with their sides showing away from the swirler vane support 13. Between neighbouring swirler vanes 12 swirler passages 14 are formed. The swirler passages 14 extend between a swirler passage inlet opening 15 and a swirler passage outlet opening 16. The swirler passages 14 are delimited by opposing side faces 16 of swirler vanes 12, by the surface of the swirler vane support 13 which shows to the burner head (not shown) and by a surface of the burner head to which the swirler vanes 12 are fixed. Outlet openings 5 and third openings 6 are arranged in the swirler passages 14 in the swirler vane support 13.

Figure 4:
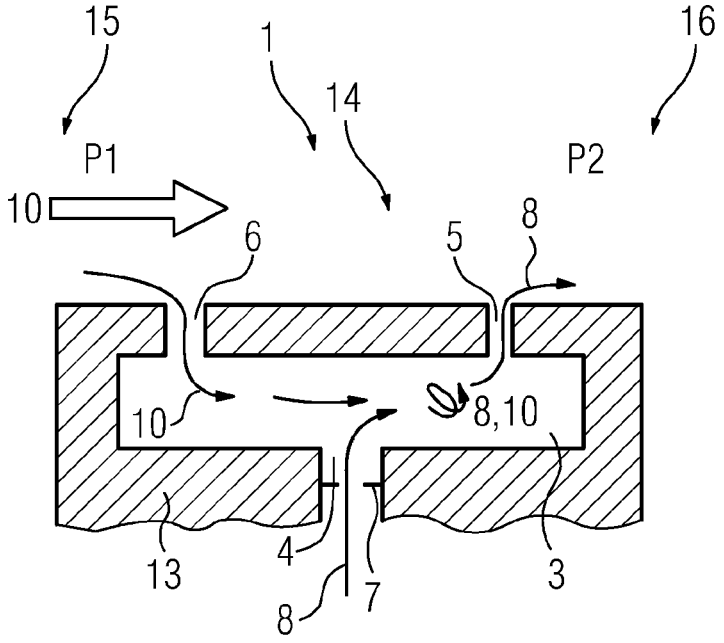
FIG. 4 represents a fuel distributor arranged in a swirler base plate with openings in the swirler base plate at low fuel flow.
Figure 5:
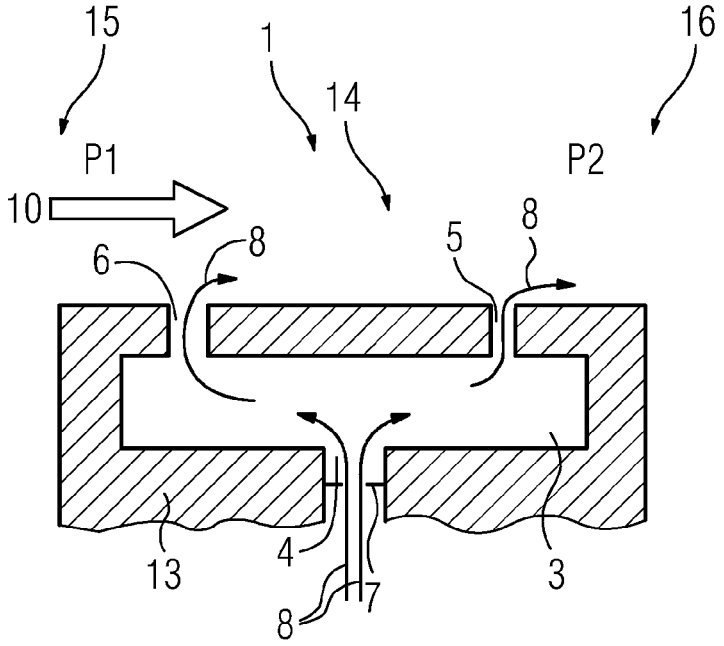
FIG. 5 represents a fuel distributor arranged in a swirler base plate with openings in the swirler base plate at high fuel flow.

Referring to FIGS. 4 and 5 a cross-sectional view of an inventive fuel distributor 1 arranged in a swirler vane support 13 is shown. The outlet opening 5 and the third opening 6 open out into a swirler passage 14. Compressor air 10 is entering the swirler passage 14 from the left by the swirler passage inlet opening 15, where the pressure P1 exceeds the pressure P2 at the swirler passage outlet opening 16. FIG. 4 shows the fuel distributor at low loads. Fuel 8 enters the cavity 3 of the fuel distributor 1 by the inlet opening 4 through the restrictor 7. A predominant proportion of the fuel 8 enters the swirler passage 14 through the outlet opening 5. Only a small amount of fuel 8 enters the swirler passage 14 through the third opening 6. This is beneficial for providing pilot fuel to the outlet opening 5. At very low load a part of the compressor air 10 entering the swirler passage 14 flows into the cavity 3 through the third opening 6, leading to some premixing in the cavity 3.

At high loads the proportion of fuel 8 entering the swirler passage 14 through the third opening 6 is increased, as shown in FIG. 5. The fuel pressure in the cavity 3 overcomes the pressure at the swirler passage inlet opening 15 and fuel 8 spills out into the swirler passage 14 mainly through the third opening 6 with the larger cross-sectional area.

Figure 6:
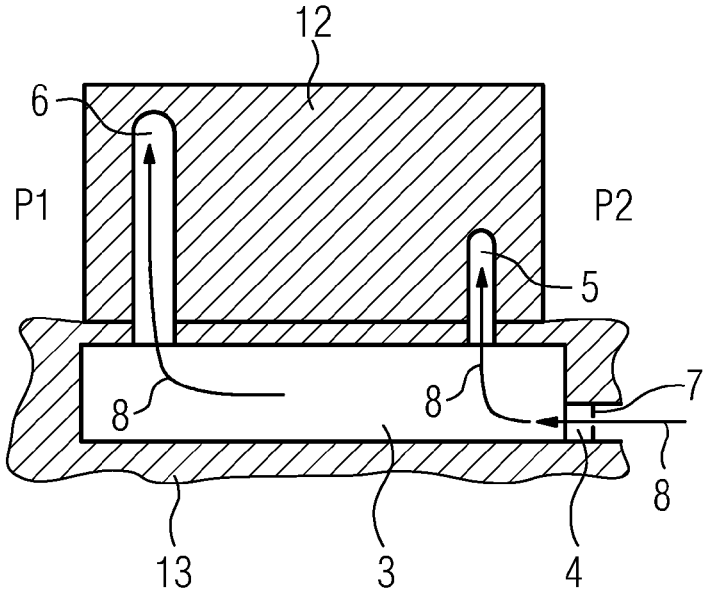
FIG. 6 represents a fuel distributor arranged in a swirler base plate with openings in the side face of a swirler vane.
Figure 7:
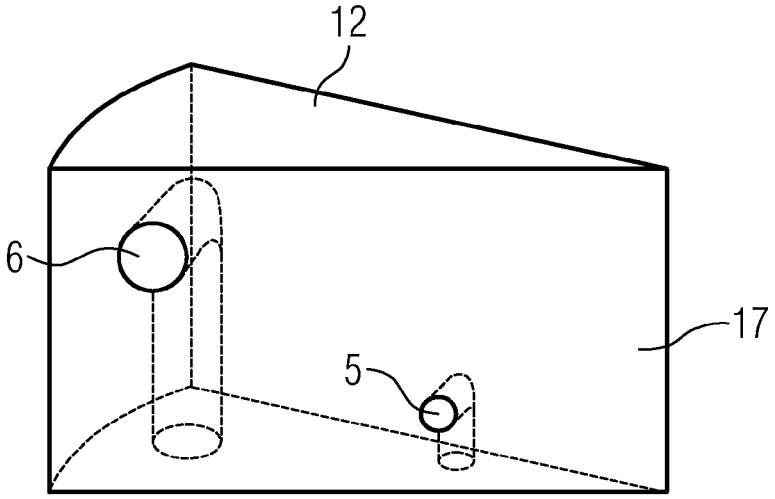
FIG. 7 shows a swirler vane corresponding to the fuel distributor of FIG. 7.

FIGS. 6 and 7 show an alternative arrangement where the distribution of the fuel flow 8 across the height of the swirler passage 14 could be varied. The cavity 3 of the fuel distributor 1 is again arranged in the swirler vane support 13. The outlet opening 5 and the third opening 6 are arranged at different heights of the swirler vane 12 in the swirler passage 14. Again, the outlet opening 5 has a smaller cross-sectional area and is arranged close to the swirler passage outlet opening 16, where the pressure is low and the third opening 6 has a larger cross-sectional area and is arranged close to the swirler passage inlet opening 15, where the pressure is higher than at the swirler passage outlet opening 16.

Figure 8:
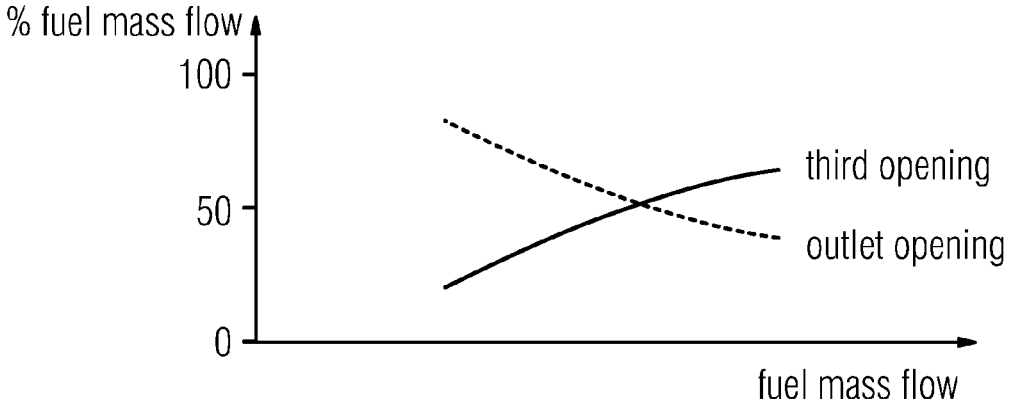
FIG. 8 shows the percentage of mass flow through the fuel injection openings as a function of the fuel mass flow.

Referring to FIG. 8 the percentage of fuel mass flow through the outlet opening 5 and the third opening 6 as a function of the total fuel mass flow is shown. At low load, i.e. at low mass flow, fuel mainly flows through the outlet opening 5. The higher the fuel mass flow the higher the percentage of fuel flowing through the third opening 6.

Figure 9:
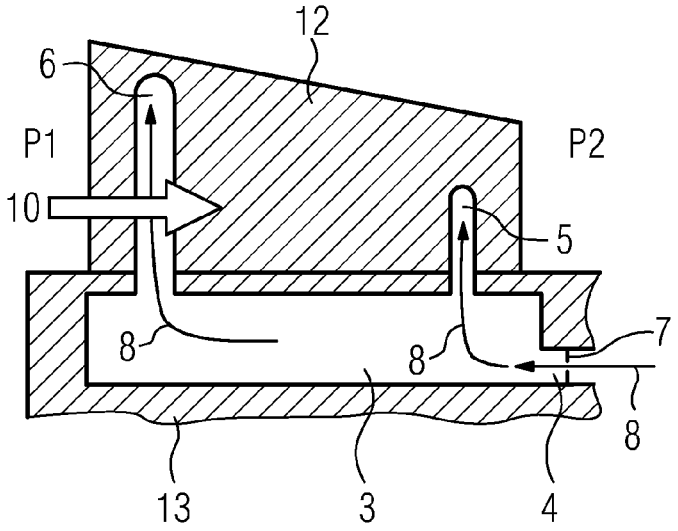
FIG. 9 represents a fuel distributor arranged in a swirler base plate with openings in the side face of a swirler vane and converging swirler passage.

FIG. 9 shows a further embodiment of the inventive fuel distributor 1. The general layout is similar to the embodiment described in FIG. 6. The pressure drop of the air 10 in the swirler passage 14 between the outlet opening 5 and the third opening 6 is varied by making the swirler passage 14 convergent (as shown in FIG. 9) or divergent (not shown).

What is claimed is:

1. A swirler, comprising:

a swirler vane support;

a plurality of swirler vanes arranged on the swirler vane support;

a plurality of swirler passages for compressed air formed by the swirler vanes and the swirler vane support, wherein each swirler passage extends from a radially outer inlet to a radially inner outlet; and a plurality of fuel distributors, each of the fuel distributors, comprising:

a distribution element defining a cavity, wherein the cavity has an inlet opening, an outlet opening and a third opening, wherein the third opening is arranged in the cavity of the fuel distributor in an upstream section of a respective swirler passage with respect to a flow direction of compressed air, and the outlet opening is arranged in the cavity in a downstream section of the respective swirler passage with respect to the flow direction of compressed air, wherein a first cross-section of the third opening is larger than a second cross-section of the outlet opening, and wherein said cavity is entirely defined inside the swirler vane support.

2. A swirler as claimed in claim 1, wherein a restrictor is arranged upstream, relative to a fuel flow, the inlet opening of a respective fuel distributor, and wherein the restrictor is sized and configured to balance between a first fuel flow through the outlet opening and a second fuel flow through the third opening.

3. A swirler as claimed in claim 2, wherein the restrictor of the fuel distributor is adjustable.

4. A swirler as claimed in claim 1, wherein the outlet opening of the fuel distributor is a pilot fuel injection opening.

5. A swirler as claimed in claim 1, wherein the third opening of the fuel distributor is a main fuel injection opening.

6. A swirler as claimed in claim 1, wherein the plurality of outlet openings and the plurality of third openings of the plurality of fuel distributors are arranged in the plurality of swirler passages.

7. A swirler as claimed in claim 1, wherein the plurality of outlet openings are arranged at a downstream end of the plurality of swirler passages relative to the flow direction of compressor air.

8. A swirler as claimed in claim 1, wherein the plurality of third openings are arranged at an upstream end of the plurality of swirler passages relative to the flow direction of compressor air.

9. A swirler as claimed in claim 1, wherein the plurality of outlet openings and the plurality of third openings are arranged in the swirler vanes support.

10. A swirler as claimed in claim 1, wherein a cross-sectional area of each swirler passage increases in a downstream direction relative to the flow of compressor air.

11. A swirler as claimed in claim 1, wherein the cross-sectional area of each swirler passage decreases in the downstream direction relative to the flow of compressor air.

* * * * *